US006304740B1

(12) United States Patent
Ciaschi et al.

(10) Patent No.: US 6,304,740 B1
(45) Date of Patent: Oct. 16, 2001

(54) EXTERNALLY HEATED EXTERNAL HEARTED ROLLERS

(75) Inventors: Andrew Ciaschi, Lima; Borden H. Mills, Webster; Jiann-Hsing Chen, Fairport; Socrates Hryhorenko, Sodus, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/500,826

(22) Filed: Feb. 10, 2000

(51) Int. Cl.[7] ..... G03G 15/20

(52) U.S. Cl. ..... 399/328; 219/216; 219/469; 430/99

(58) Field of Search ..... 399/328, 330, 399/320; 219/216, 469; 432/59; 430/124, 99; 347/156

(56) References Cited

U.S. PATENT DOCUMENTS

| | | | | |
|---|---|---|---|---|
| 3,811,821 | * | 5/1974 | Ariyama et al. | 219/216 X |
| 3,945,726 | * | 3/1976 | Ito et al. | 219/216 X |
| 4,001,545 | * | 1/1977 | Wada et al. | 219/216 |
| 4,355,225 | | 10/1982 | Marsh | 219/216 |
| 4,905,050 | | 2/1990 | Derimiggio et al. | 399/331 |
| 4,963,943 | | 10/1990 | Tamary | 399/335 |
| 4,984,027 | | 1/1991 | Derimiggio et al. | 399/331 |
| 5,210,580 | * | 5/1993 | Aslam et al. | 399/328 |
| 5,223,099 | | 6/1993 | Salo | 162/207 |
| 5,408,070 | | 4/1995 | Hyllberg | 219/469 |
| 5,420,395 | | 5/1995 | Hyllberg et al. | 219/470 |
| 5,450,183 | * | 9/1995 | O'Leary | 399/328 X |
| 5,805,968 | * | 9/1998 | Chatterjee et al. | 399/328 X |
| 5,872,350 | * | 2/1999 | Moser | 219/216 |
| 5,984,848 | | 11/1999 | Hyllberg et al. | 492/46 |

FOREIGN PATENT DOCUMENTS

| | | | |
|---|---|---|---|
| 8-314323 | * | 11/1996 | (JP) . |
| 10-301417 | * | 11/1998 | (JP) . |
| 10-333477 | * | 12/1998 | (JP) . |

* cited by examiner

*Primary Examiner*—Sophia S. Chen
(74) *Attorney, Agent, or Firm*—Lawrence P. Kessler

(57) ABSTRACT

A fusing apparatus for fusing toner images on a receiver medium. The fusing apparatus includes a fuser member having a contact surface and a pressure member having a contact surface. The pressure member is positioned adjacent the fuser member for forming a nip therebetween to receive the receiver medium. The pressure member controllably exerts pressure on the fuser member and the receiver medium. A first heater member has a contact surface and is positioned adjacent the fuser member and external thereto, the surface of the heater member contacting the surface of the fuser member to transfer heat to the fuser member. The fuser member heats the toner image on the receiver medium thereby fusing the toner image to the receiver medium. A first radiant heat assembly is positioned externally of the first heater member for controllably heating the contact surface of the first heater member.

12 Claims, 2 Drawing Sheets

EXTERNALLY HEATED EXTERNAL HEARTED ROLLERS

CROSS REFERENCE TO RELATED APPLICATIONS

This application is related to Copending U.S. Patent application Ser. No. 09/501,459, filed on even date herewith entitled "Fluorocarbon Random Copolymer For Use in Externally Heated Roller".

FIELD OF THE INVENTION

The present invention relates generally to a fuser assembly for heat fixing a heat-softenable toner material to a substrate, and, more particularly, to externally heated fuser members.

BACKGROUND OF THE INVENTION

Heat-softenable toner materials are widely used in imaging processes, such as electrostatography, wherein electrically charged toner is deposited imagewise onto a dielectric or photoconductive element bearing an electrostatic latent image. Often in such processes, the toner is transferred to a surface of another substrate, such as a receiver sheet of paper or a transparent film, for example, where it is then fixed in place to yield the final desired toner image. When heat-softenable toners employing thermoplastic polymeric binders are used, the usual method of fixing the toner in place involves applying heat to the toner once it is on the receiver sheet surface to soften it, so that it bonds to the receiver sheet, and then allowing or causing the toner to cool.

One such well-known fusing system passes the toner-bearing receiver sheet through the nip formed by a pair of opposing rolls, at least one of which, usually referred to as a fuser roll, is heated. The fuser roll contacts the toner-bearing surface of the receiver sheet in order to heat and soften the toner. The other roll, usually referred to as a pressure roll, presses the receiver sheet into contact with the fuser roll. In other fusing systems, the configuration is varied with the fuser roll or pressure roll taking the form of a flat plate or belt. As used herein, the term fuser member is used to denote both cylindrical fuser rolls, plates and belts, and the term pressure member is used to denote both cylindrical fuser rolls, plates and belts.

A fuser member typically has a rigid core covered with a resilient material, which is referred to herein as a base cushion layer. The resilient base cushion layer and the amount of pressure exerted by the pressure member serve to establish the area of contact of the fuser member with the toner-bearing surface of the receiver sheet as it passes through the nip of the fuser member and pressure members. The size of this area of contact helps to establish the length of time that any given portion of the toner image will be in contact with and heated by the fuser member. The degree of hardness of the base cushion layer, often referred to as storage modulus, and stability of the base cushion layer are important factors in establishing and maintaining the desired area of contact.

In some previous fusing systems, it has been found advantageous to vary the pressure exerted by the pressure member against the receiver sheet and fuser member. This variation in pressure can be provided, for example in a fusing system having a pressure roll and a fuser roll, by slightly modifying the shape of the pressure roll. The variance of pressure, in the form of a gradient of pressure that changes along the direction through the nip that is parallel to the axes of the rolls, can be established, for example, by continuously varying the overall diameter of the pressure roll along the direction of its axis such that the diameter is smallest at the midpoint of the axis and largest at the ends of the axis giving the pressure roll a sort of bowtie or hourglass shape. This will cause the pair of rolls to exert more pressure on the receiver sheet in the nip in the areas near the ends of the rolls than in the area about the midpoint of the rolls. This gradient of pressure helps to prevent wrinkles and cockle in the receiver sheet as it passes through the nip. Over time, however, the fuser roll begins to permanently deform to conform to the shape of the pressure roll, and the gradient of pressure is reduced or lost, along with its attendant benefits. It has been found that permanent deformation, also known as creep, of the base cushion layer of the fuser member is the greatest contributor to this problem.

Some external heater rollers for nip forming roller fusers are internally heated. These rollers usually have either an anodized surface or a Teflon surface with very low thermal resistance because of the thinness of these coatings. The thin nature of these coatings does not allow a large contact length when a nip is formed with a fuser roller. A longer nip would allow more heating time for the fusing surface. To achieve a longer nip, an elastomer layer, thicker than the anodized or Teflon coatings, can be applied to the heater roller, but that creates a time delay for the heat energy to reach the heater roller surface because of an increase in thermal resistance due to increased thickness of the elastomer surface. A time delay increases thermal response time when altering the fuser roller temperature for any process reason. This increase in thermal response time can preclude the use of gloss control through fuser roller temperature changes, or gloss and fusion tuning for various receiver types. Various receiver types have different thermal properties that affect gloss and fusion quality. The ability to change the fuser roller surface temperature within the time between consecutive receivers allows fusion and glossing to be tuned to receivers within a document run that are of different types without reducing the productivity of the entire electrostatographic system.

SUMMARY OF THE INVENTION

The present invention is directed to overcoming one or more of the problems set forth above. According to one aspect of the invention, a fusing apparatus for fusing toner images on a receiver medium comprises a fuser member and a pressure member that is positioned adjacent the fuser member forming a nip therebetween to receive the receiver medium. The pressure member controllably exerts pressure on the fuser member and the receiver medium. A first heater member is positioned adjacent the fuser member and external thereto with a surface of the heater member contacting a surface of the fuser member to transfer heat to the fuser member. The fuser member heats the toner image on the receiver medium thereby fusing the toner image to the receiver medium. A radiant heat assembly is positioned externally of the heater member for controllably heating the contact surface of the first heater member.

According to another aspect of the invention, a method for electrostatographically producing fused toner images on a substrate comprises the steps of electrostatically forming image patterns on an image bearing member, developing the image patterns with fusible toner particles and forming a toner image, transferring the toner image to the substrate, feeding the substrate into a nip formed between a fuser member and a pressure member, and externally heating an outer surface of a heater member. The method also includes using the heater member to externally heat the fuser member, and controllably transmitting heat and pressure to the substrate through the heater member and pressure member at a predetermined fuser roller surface temperature set point that achieves a 0° F. to 200° F. increase in fuser member surface temperature between consecutive sheets thereby fusing the toner images onto the substrate at a desired toner surface roughness.

The present invention provides a fuser roller that overcomes the limitations and disadvantages associated with cored, coated rollers. It is particularly suitable for external heating, and for use in an axially unsupported configuration in a fusing apparatus. The fusing apparatus for fusing toner images to a receiver or copy sheet, through the application of heat and pressure, includes a fuser roller that is comprised entirely of a cylindrical inner portion which is made of a first elastomeric material, and of an annular outer portion which is made of a second elastomeric material overlaying the inner portion.

Direct heating of the heater roller surface allows surface temperatures to be changed to alter a fusing process within consecutive sheets. A method to do this uses an externally heated external heater roller to impart thermal energy to a fuser roller through conduction or direct contact. The heater roller has an elastomer layer to increase nip length and heating time. The heater roller is heated by an external radiant heat source. Heating the heater roller with a radiant source imparts energy directly to the roller surface and not indirectly through a roller core and elastomer layer.

The ability to quickly change the fuser roller surface temperature allows for gloss control and thermal droop management without having to artificially boost and cool the fusing roller surface temperature to increase the stored energy in the fuser roller base cushion, while maintaining fusing temperature-control set-point. The external radiant heating allows internal components to remain cooler than in an internally heated system which can either increase component life or reduce component cost if the component life requirement remains the same.

Direct radiation from the external radiant heat source to the paper sheet is shielded to reduce the probability of over heating the paper. This is possible because radiation from the external heat source impinges on the heater roller and not the fuser roller. If a sheet of paper wraps around the fuser roller, it will pass between the heater roller and the fuser roller, not between the heater roller and the radiant heat source. By this construction, the heater roller itself shields most, if not all, of the radiation.

When a paper wraps itself around the fuser roller, due to a release failure of the paper from the fuser roller, an elastomer skive finger stops or strips the paper from the fuser roller before it reaches the heater roller.

DETAILED DESCRIPTION OF THE INVENTION

Figure 1:
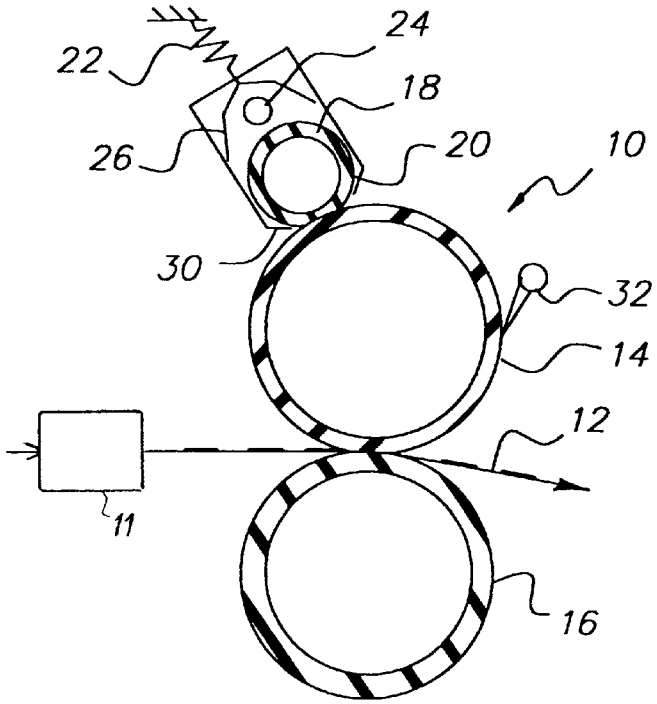
FIG. 1 is a diagrammatic cross-sectional view of a preferred embodiment of a 2-pass fuser assembly for an electrostatographic unit according to the present invention.
Figure 2:
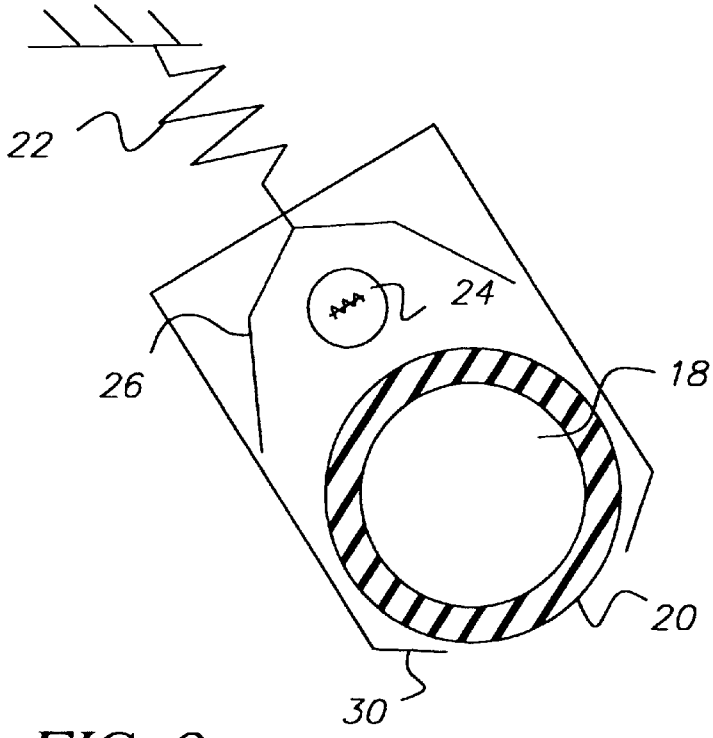
FIG. 2 is a somewhat enlarged view of the externally heated external roller assembly of the 2-pass fuser assembly of FIG. 1.

Referring to FIGS. 1 and 2, a single roller version of fusing apparatus 10 is used for fusing toner images on a receiver medium 12 in an electrostatographic production machine designated generally by the numeral 11, wherein electrostatically formed image patterns developed by fusible toner particles transferred to a receiver medium substrate. The fusing apparatus includes a fuser member, such as fuser roller 14 which has an elastomer surface layer, and a pressure member, such as pressure roller 16 which also has an elastomer surface layer. Pressure member 16 is positioned adjacent fuser member 14 forming a nip therebetween to receive the receiver medium 12. Pressure member 16 controllably exerts pressure on fuser member 14 to vary the surface contact with receiver medium 12 in the nip. Pressure tends to flatten fuser member 14 in the nip and thereby increase surface area available to contact the receiver. Surface finish on the receiver is a function of heat and pressure with a flattened fuser member having a longer contact time with the receiver to deliver more heat even though fuser member surface temperature remains at a given set point. The heater member and pressure member provide heat and pressure to produce a desired toner surface roughness at a predetermined fuser member surface temperature set point that could achieve a differential of 0° F. to a differential of 200° F. temperature rise at the contact surface of the fuser member between consecutive sheets. For example, if a fuser roller set-point temperature was 340° F, and during the fusing of fuser member surface, the temperature dropped to 300° F, the said external heater roller could boost the temperature back to the set-point between consecutive fuser members; or if a smoother fuser member surface finish were required, the temperature could be boosted to a higher set point, such as 360° F. within consecutive fuser members. There are an infinite number of differential temperature ranges, between 0° F. and 200° F., that could be attained that would depend upon the pressure nip length, fuser roller materials used, and the initial fuser roller surface temperature. Differential temperature ranges of, for example, 80 and 100 might be useful and practical during operation and would be attainable using the present invention.

A heater assembly for heating fuser member 14 includes a heater member, such as heater roller 18. Heater member 18 preferably has surface layers 20 of high temperature elastomer material between 1 mil and 500 mils thick. Preferably, the elastomer surface layer configuration uses a compressible base cushion, such as Viton™ foam for example, with a thin top layer, such as solid Viton™, that has a high concentration of a thermally conductive filler. The foam base cushion allows the formation of a pressure nip with an adequate nip length for heating time. It also allows a nip with little or no velocity overdrive due to compressibility of the foam. The top layer is non-porous and smooth for maximum thermal contact area, cleaning ability, and retention of a smooth layer of oil on the fuser member to thereby avoid oiling image artifact patterns. The Viton™ polymer material can withstand continuous operating temperatures of 300° C. and a maximum of 350° C. This operating temperature allows the heater member surface to be heated to 300° C., which is 67° C. higher than some current heater members. The top layer, with a much higher thermal conductivity than the foam base cushion, can quickly transfer its heat to the fuser member, while the foam base cushion is comparatively a thermal insulator. This balance of thermal conductivity allows heat to be stored most efficiently in the top layer of the elastomer layers.

The outermost polymer layer has the highest possible thermal conductivity to minimize the thermal time constant for transferring heat to the fuser member 14. A base layer or base cushion may be elastomer foam for compliance to generate a large pressure nip with fuser member 14.

The heater assembly also has a loading system 22 to form the pressure nip between heater member 18 and fuser member 14, and a radiant heat assembly positioned externally of first heater member for controllably heating the contact surface of the first heater member. The radiant heat assembly includes a radiant heat source 24 and a reflector 26 for focusing radiant energy from radiant heat source 24 toward heater member 18. A quartz tube with an electrically resistive internal heating element can be used as the heat source, with an elliptical or parabolic radiation reflector. This type of heater emits infrared energy that is evenly distributed across heater member 18 and is easily absorbed by the elastomer heater member surface. The quartz tube heater element has low thermal mass for quick heat-up and cool-down, but any type of radiant heat source could be used, such as ceramic panels and electrically resistive metal rods and bars, or lamps.

Figure 3:
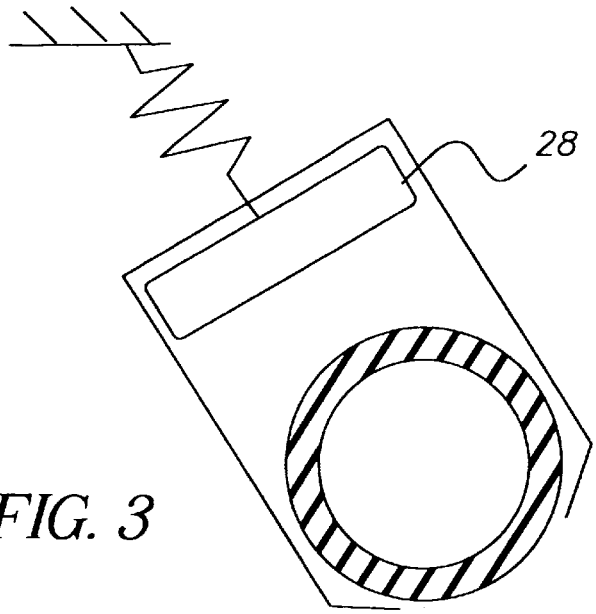
FIG. 3 is a somewhat enlarged view of the externally heated external roller assembly similar to FIG. 2 but illustrating another preferred embodiment.

FIG. 3 illustrates a ceramic panel 28 as a radiant heat source. A reflector is not needed with ceramic panel 28.

Again referring to FIGS. 1 and 2, a radiation shield 30 is positioned about heater member 18 to prevent radiant energy emanating from radiant heat source 24 from directly impinging fuser member 14.

A finger skive 32 is mounted near fuser member 14 along the path of the receiver medium as it exits the nip to remove the receiver medium from the fuser member before the receiver medium reaches the heater member. This skive peels off the receiver medium before it reaches the heater roller. This feature reduces the probability of the receiver medium ever reaching the heater member. If the skive is articulated, plastic or metal fingers could be used because contact would only be made during stoppages or paper wrap around the fuser roller.

The fusing apparatus 10 is a single heater, double pass apparatus that fuses toner on one side of the receiver at a time using the single heater. For faster heating, a second heater could be used to help heat the fuser member, or to heat the pressure member. In the double pass system, the receiver passes through the nip twice, once for each side.

Figure 4:
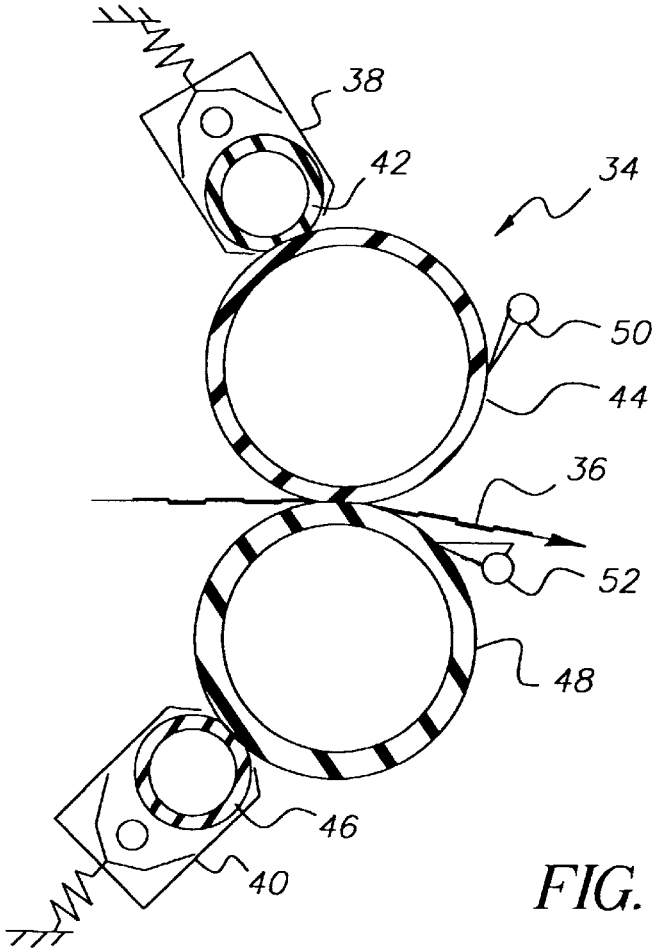
FIG. 4 is a diagrammatic cross-sectional view of a preferred embodiment of a 1-pass fuser assembly for an electrostatographic unit according to the present invention.

Referring to FIG. 4, a fusing apparatus 34 fuses toner images on both sides of a receiver medium 36 in a single pass through the nip by using two heater assemblies 38, 40. Heater assembly 38 uses heater member 42 to heat fuser member 44, and heater assembly 40 uses heater member 46 to heat pressure member 48. Fuser member 44 has finger skive 50 to remove the receiver, while pressure member 48 has finger skive 52 to remove the receiver. A single-pass duplex fuser member preferably has a thicker layer of elastomer on its surface than the pressure member. This elastomer configuration causes the sheet receiver to exit the nip in a direction towards the pressure member. Having different thickness elastomer on each member creates different thermal resistances for each member so that each member will absorb heat at different rates. To compensate for the different heating rates of the fuser and pressure members 44, 48, the external heaters can be loaded differently to create different sized pressure nips. Differently sized pressure nips will result in differences in heating time, which allows different heating rates to compensate for the different elastomer thickness on each member.

A method for electrostatographically producing fused toner images on a receiver medium includes electrostatically forming image patterns on an image bearing member, developing the image patterns with fusible toner particles forming a toner image, transferring the toner image to the receiver medium, and feeding the substrate into a nip formed between a fuser member and a pressure member. The method also includes externally heating an outer surface of a heater member, using the heater member to externally heat the fuser member, and controllably transmitting heat and pressure to the substrate through the heater member and pressure member at a predetermined fuser roller surface temperature set point that achieves a differential temperature of 0° F. to a differential temperature of 200° F. between consecutive sheets thereby fusing the toner images onto the receiver medium at a desired toner surface roughness. Focusing radiation in a predetermined direction using reflectors increases the efficiency of heat transfer. Providing protective radiation shielding about the heater members concentrates the heat to increase the efficiency of heat transfer.

It can now be appreciated that a fusing apparatus has been presented that has externally heated external heater members. The fuser member is polymer coated which allows a larger nip. Having more nip time enables high volume or high speed heating of the fuser member surface without thermal droop. The foam base cushion permits compression to form a large nip. The foam base cushion also allows for a pressure nip with virtually no velocity overdrive. This reduces relative motion in the nip thereby reducing fuser member surface wear. A high temperature elastomer allows a large temperature gradient to be formed between the fuser member and the heater member, which maximizes heating time or dwell. Fusing member surface temperatures are generally around 100° C. to 200° C. More than one heater assembly can be used to increase the heating rate External heating allows components, except top layer coatings, to operate at cooler temperatures which increases reliability by increasing life, or reducing cost by using components not rated for as high a temperature as internally heated systems. Base cushion thickness is not limited by heat transfer rates, but only by mechanical strain. Thicker base cushions, as compared to internally heated systems, can be used to form large pressure nips for obtaining extended dwell. Extended heating nip lengths can be used to increase fusing speed thereby increasing the productivity of a system, or one could reduce the size of a roller core to reduce the overall space the apparatus needs.

The invention has been described in detail with particular reference to certain preferred embodiments thereof, but it will be understood that variations and modifications can be effected within the spirit and scope of the invention.

What is claimed is:

1. A fusing apparatus for fusing toner images on a receiver medium, comprising:

a fuser member having a contact surface;

a pressure member having a contact surface and being positioned adjacent said fuser member forming a nip therebetween to receive said receiver medium, said pressure member controllably exerting pressure on said fuser member and the receiver medium;

a first heater member having a contact surface and being positioned adjacent said fuser member and external thereto, said surface of said heater member contacting said surface of said fuser member to transfer heat to said fuser member, said fuser member heating a toner image on the receiver medium thereby fusing such toner image to the receiver medium; and a first radiant heat assembly positioned externally of said first heater member for controllably heating said contact surface of said first heater member, said first radiant heat assembly including a radiant heat source directing radiant energy toward said first heater member and a radiation shield positioned about said heater member to prevent radiant energy emanating from said radiant heat source from directly impinging upon said fuser member.

2. A fusing apparatus, as set forth in claim 1, including:

a second heater member having a contact surface and being positioned adjacent said pressure member and external thereto, said surface of said second heater member contacting said surface of said pressure member to transfer heat to said pressure member, said pressure member heating the toner image on the receiver medium thereby fusing the toner image to the receiver medium; and a second radiant heat assembly positioned externally of said second heater member for controllably heating said contact surface of said second heater member.

3. A fusing apparatus, as set forth in claim 1, wherein said first heater member and said pressure member provide heat and pressure to produce a desired toner surface roughness at a predetermined fuser member surface temperature set point that achieves a differential temperature of 0° F. to a differential temperature of 200° F. of said fuser member between consecutive sheets.

4. A fusing apparatus, as set forth in claim 1, wherein said surface of said first heater member is an elastomer having a thickness in a range of 1 to 500 mils.

5. A fusing apparatus, as set forth in claim 1, wherein said first radiant heat assembly includes a reflector for focusing radiant energy from said radiant heat source toward said first heater member.

6. A fusing apparatus, as set forth in claim 1 including a skive finger mounted near said fuser member along the path of the receiver medium as it exits the nip to remove the receiver medium from said fuser member before the receiver medium reaches said heater member.

7. A fusing apparatus for fusing toner images on a receiver medium, said receiver medium having first and second sides for receiving toner images, said apparatus comprising:

a fuser member having a contact surface;

a pressure member having a contact surface and being positioned adjacent said fuser member forming a nip therebetween to receive said receiver medium, said pressure member controllably exerting pressure on said fuser member and the receiver medium;

a first heater member having a contact surface and being positioned adjacent said fuser member and externally thereto, said surface of said first heater member contacting said surface of said fuser member to transfer heat to said fuser member, said fuser member directly heating a toner image on the first side of the receiver medium thereby fusing such toner image to the first side of the receiver medium;

a first radiant heat source positioned externally of said first heater member for controllably heating said contact surface of said first heater member, and a radiation shield positioned about said heater member to prevent radiant energy emanating from said radiant heat source from directly impinging upon said fuser member;

a second heater member having a contact surface and being positioned adjacent said pressure member and externally thereto, said surface of said second heater member contacting said surface of said pressure member to transfer heat to said pressure member, said pressure member directly heating a toner image on the second side of the receiver medium thereby fusing such toner image to the second side of the receiver medium;

second radiant heat source positioned externally of said second heater member for controllably heating said contact surface of said second heater member, and a radiation shield positioned about said heater member to prevent radiant energy emanating from said radiant heat source from directly impinging upon said pressure member.

8. A fusing apparatus, as set forth in claim 7, wherein said heater members and said pressure member provide heat and pressure to produce a desired toner surface roughness at a predetermined set point temperature that achieves anywhere from a 0° F. to 200° F. temperature rise at said nip.

9. A fusing apparatus, as set forth in claim 7 including at least one skive finger mounted along the path of the receiver medium as it exits the nip to remove the receiver from said fuser member and said pressure member before the receiver reaches one of said first and second heater members.

10. A method for electrostatographically producing fused toner images on a substrate, comprising the steps of:

electrostatically forming image patterns on an image bearing member;

developing the image patterns with fusible toner particles and forming a toner image;

transferring the toner image to the substrate;

feeding the substrate into a nip formed between a fuser member and a pressure member;

externally heating an outer surface of a heater member;

using the heater member to externally heat the fuser member; and controllably transmitting heat and pressure to the substrate through the heater member and pressure member at a predetermined fuser roller surface temperature set point that achieves anywhere from a 0° F. to 200° F. increase in fuser member surface temperature between consecutive sheets thereby fusing the toner images onto the substrate at a desired toner surface roughness.

11. The method of claim 10, including the step of focusing radiation in a predetermined direction using reflectors.

12. The method of claim 11, including the step of providing protective radiation shielding about the heater member.

* * * * *

UNITED STATES PATENT AND TRADEMARK OFFICE

CERTIFICATE OF CORRECTION

PATENT NO. : 6,304,740 B1
DATED : October 16, 2001
INVENTOR(S) : Ciaschi et al.

It is certified that error appears in the above-identified patent and that said Letters Patent is hereby corrected as shown below:

Title page, Item [54] and Column 1, lines 1-2,
Correct the title to read: -- EXTERNALLY HEATED EXTERNAL HEATER ROLLERS --

Signed and Sealed this

Fifth Day of November, 2002

*Attest:*

*Attesting Officer*

JAMES E. ROGAN
*Director of the United States Patent and Trademark Office*